US007859818B2

(12) United States Patent
Kroll et al.

(10) Patent No.: US 7,859,818 B2
(45) Date of Patent: Dec. 28, 2010

(54) ELECTRONIC CONTROL DEVICE WITH WIRELESS PROJECTILES

(75) Inventors: Ryan Kroll, Crystal Bay, MN (US); Mark Kroll, Crystal Bay, MN (US)

(73) Assignee: Kroll Family Trust, Crystal Bay, MN (US)

( * ) Notice: Subject to any disclaimer, the term of this patent is extended or adjusted under 35 U.S.C. 154(b) by 184 days.

(21) Appl. No.: 12/250,178

(22) Filed: Oct. 13, 2008

(65) Prior Publication Data

US 2010/0089273 A1 Apr. 15, 2010

(51) Int. Cl.
*F42B 8/00* (2006.01)

(52) U.S. Cl. ..... 361/232; 102/502

(58) Field of Classification Search ..... 361/232; 42/1.08; 102/502
See application file for complete search history.

(56) References Cited

U.S. PATENT DOCUMENTS 5,698,815 A * 12/1997 Ragner ..... 102/502
6,636,412 B2 10/2003 Smith
6,802,262 B1 * 10/2004 Warnagiris et al. ..... 102/502
6,862,994 B2 3/2005 Chang
7,096,792 B1 8/2006 Carman
7,421,951 B2 * 9/2008 Genis et al. ..... 102/502
2006/0256498 A1 11/2006 Smith

* cited by examiner

*Primary Examiner*—Danny Nguyen
(74) *Attorney, Agent, or Firm*—Vidas, Arrett & Steinkraus

(57) ABSTRACT

A wireless projectile for use with a hand-held electronic control device includes a housing, one or more capacitors disposed within the interior of the housing, and one or more probes in electrical communication with the capacitor(s) The probe(s) are disposed within the housing in the first end region of the housing when the projectile is in a first state, and the probe(s) extend through the first end of the housing when the projectile is in the second state. The projectile does not comprise a battery or an inverter to charge the capacitor.

17 Claims, 11 Drawing Sheets

ELECTRONIC CONTROL DEVICE WITH WIRELESS PROJECTILES

CROSS-REFERENCE TO RELATED APPLICATIONS

Not Applicable

STATEMENT REGARDING FEDERALLY SPONSORED RESEARCH

Not Applicable

FIELD OF THE INVENTION

The present invention relates to electroshock devices in general. More particularly, in some embodiments this invention relates to electronic control devices capable of firing wireless projectiles for the purpose of delivering electrical shocks to a target.

BACKGROUND OF THE INVENTION

Electronic control devices (ECDs) for incapacitating humans and animals are well known. One of the most well-known manufacturers of electronic control devices is TASER® International, Inc. The X26 model hand-held ECD is one of the most used TASER® products. The X26 model operates basically as follows: the weapon launches a first dart and a second dart; each dart remains connected to the weapon by an electrically conductive wire; the darts strike an individual; and electrical pulses from the weapon travel to the first dart, from the first dart travel through the individual's body, into the second dart, and return to the weapon via the electrically conductive wire attached to the second dart. More information related to TASER® hand-held ECDs can be found in U.S. Pat. No. 6,636,412, the entire contents of which are expressly incorporated herein by reference While hand-held ECDs such as the TASER® X26 are extremely effective, there may be situations in which the user would prefer a hand-held ECD that discharged wireless projectiles to incapacitate an individual. Information related to embodiments of wireless projectiles and hand-held ECDs used for launching wireless projectiles may be found in U.S. Pat. Nos. 6,862,994 and 7,096,792, the entire contents of each being expressly incorporated herein by reference. The device described in U.S. Pat. No. 6,862,994 suffers from at least the following disadvantages: a single, large shock simply acts as an irritation to the recipient; a single, large shock does not incapacitate the recipient's muscles; and, any electric field generated by the projectile is limited in its effectiveness because of the projectile's narrow electrode spacing.

Another example of a wireless ECD projectile is described in U.S. Patent Application Publication No 2006/0256498 to Smith et al (hereafter "Smith"), the entire contents of which is expressly incorporated herein by reference Smith teaches a projectile that, unlike embodiments of the present invention, includes a battery and a charging transformer.

The art referred to or described above is not intended to constitute an admission that any patent, publication or other information referred to herein is "prior art" with respect to this invention.

All U.S. patents and applications and all other published documents mentioned anywhere in this application are incorporated herein by reference in their entirety.

Without limiting the scope of the invention, a brief summary of some of the claimed embodiments of the invention is set forth below Additional details of the summarized embodiments of the invention and/or additional embodiments of the invention may be found in the Detailed Description of the Invention below A brief abstract of the technical disclosure in the specification is provided for the purposes of complying with 37 C F R §1.72

BRIEF SUMMARY OF THE INVENTION

In at least one embodiment, the invention is directed to a wireless projectile, or capacitor bullet, for use with a hand-held ECD. The projectile has a first state and a second state. The projectile comprises a housing having a first end, a second end, a first end region, and a second end region. The housing further has an interior and an exterior The projectile further comprises at least one capacitor disposed within the interior of the housing between the first end and the second end. The capacitor has a first end and a second end, the first end of the capacitor being in electrical communication with a first charging member, the second end of the capacitor being in electrical communication with a second charging member The projectile further comprises one or more probes in electrical communication with the first charging member. The probe(s) are disposed within the housing in the first end region in the first state, and extend through the first end of the housing in the second state.

In some embodiments, the projectile, in the first state, includes kinetic energy absorption material being located substantially within the first end region.

In at least one embodiment, the projectile, in the first state, includes one or more over-pressure release pores. The projectile is designed to expel at least some of the kinetic energy absorption material through the pore(s) upon transitioning from the first state to the second state In some embodiments, the kinetic energy absorption material is a water-based polymer In at least one embodiment, the kinetic energy absorption material is an air gap.

In some embodiments, the projectile includes one or more shearing members. In at least one embodiment, the shearing member is a telescoping ring.

In some embodiments, the second charging member is in electrical communication with the exterior of the conductive housing In at least one embodiment, the first charging member is a first ring, and the second charging member is a second ring.

In some embodiments, the second end of the capacitor is in electrical communication with an oscillator, the probe(s) are in electrical communication with a switch, and the switch is in electrical communication with the oscillator.

In at least one embodiment, the projectile further includes a current sensing element in electrical communication with the oscillator. In some embodiments, the current sensing element is a resistor In at least one embodiment, the projectile further includes sensing circuitry constructed and arranged to detect other projectiles In some embodiments, the sensing circuitry includes a current limiting element, a voltage limiting element, and a first amplifier. The current limiting element and the voltage limiting element are engaged to an input of the amplifier. The amplifier has an output in electrical communication with a peak detector. The peak detector is in communication with the input of a second amplifier.

In at least one embodiment, the present invention is directed towards a hand-held ECD. The ECD includes a barrel, a magazine, one or more batteries, and one or more propulsion units. The magazine is engaged to the barrel and is constructed and arranged to house a wireless projectile. The projectile has a first state and a second state. The projectile includes a housing having a first end, a second end, a first end region, and a second end region The housing further has an interior and an exterior. The projectile further includes one or more capacitors disposed within the interior of the housing between the first end and the second end. The capacitor(s) has a first connection and a second connection, the first connection being in electrical communication with a first charging member, the second connection being in electrical communication with a second charging member The projectile further includes one or more probes. The probe(s) are in electrical communication with the first charging member The probe (s) are disposed within the housing in the first end region in the first state, and in the second state, the probe(s) extending through the first end of the housing. The batteries are in electrical communication with the projectile The batteries charge each projectile. The propulsion unit(s) are constructed and arranged to expel the wireless projectile from the ECD.

In some embodiments, the propulsion unit is filled with a gas, and the ECD further includes a sonar range finder constructed and arranged to control the amount of gas used to expel the projectile from the ECD.

In at least one embodiment, the ECD further includes an alarm mechanism constructed and arranged to produce an alarm signal if no connection exists between a trigger and a projectile In some embodiments, the alarm signal is an audible alarm.

In at least one embodiment, the ECD further includes a video camera.

In some embodiments, the present invention is directed towards a method of detecting the presence of another capacitor bullet The method includes firing a wireless projectile, as described above, at a target, sensing for another capacitor bullet's signature, and delivering pulses to the target if no capacitor bullet signature is sensed.

These and other embodiments which characterize the invention are pointed out with particularity in the claims annexed hereto and forming a part hereof. However, for further understanding of the invention, its advantages and objectives obtained by its use, reference should be made to the drawings which form a further part hereof and the accompanying descriptive matter, in which there is illustrated and described embodiments of the invention.

BRIEF DESCRIPTION OF THE SEVERAL VIEWS OF THE DRAWING(S)

A detailed description of the invention is hereafter described with specific reference being made to the drawings.

DETAILED DESCRIPTION OF THE INVENTION

Figure 1:
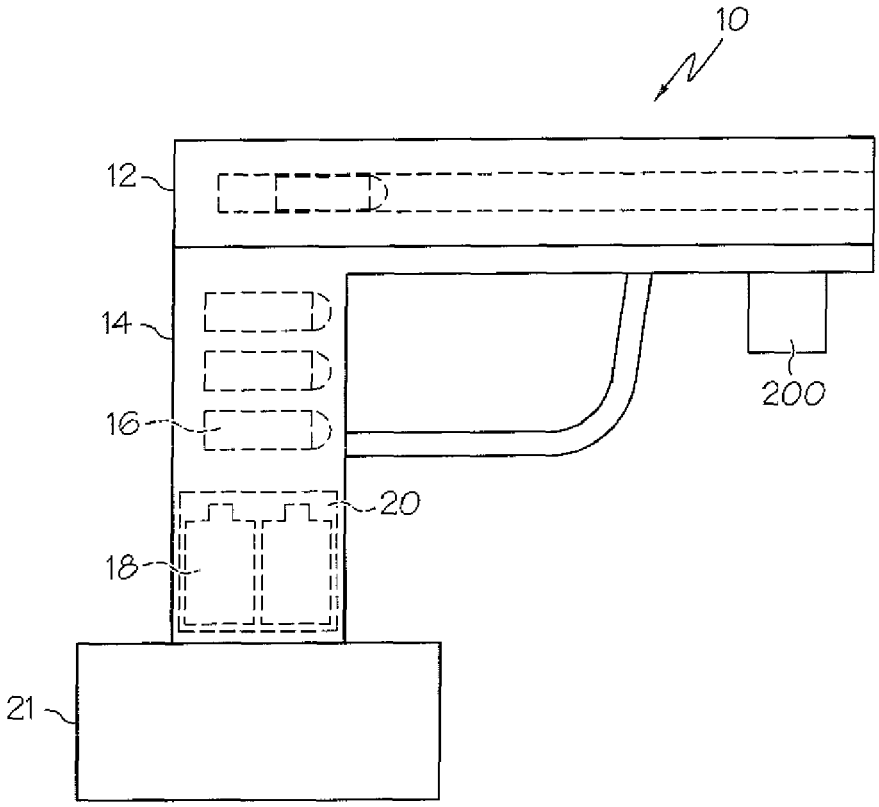
FIG. 1 is a side cutaway view of a hand-held ECD in accordance with at least one embodiment of the present invention.

While this invention may be embodied in many different forms, there are described in detail herein specific preferred embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

Embodiments of the present inventive ECD provide multiple current pulses of substantially equal charge to a subject, and deliver current over a large muscle mass to cause incapacitation of the subject.

FIG. 1 shows an embodiment of a hand-held electronic control device ("ECD") 10 for firing capacitor bullets, or wireless projectiles. The pistol 10 includes a barrel or sliding member 12 and a magazine 14. The magazine 14 contains the capacitor bullets 16, charging batteries 18, and the battery magazine 20. The bullets are pushed one at a time into the chamber for propulsion out of the barrel after the bullets are charged up to full voltage.

The wireless projectile can be expelled from the ECD by way of a propulsion unit, such as shown at 21 in FIG. 1. The propulsion unit can be filled with $CO_2$, nitrogen, compressed air, or other gases as are known and used by those skilled in the art.

It should be noted that an ECD is different from a "stun gun" A "stun gun" simply delivers irritating shocks. The presence of drugs or alcohol in violent suspects has an anesthetizing effect, thereby reducing, and oftentimes eliminating, the effects of a stun gun. In contrast, an ECD actually controls the muscles, allowing law enforcement personnel, for example, to stop a determined suspect. In some embodiments of the present invention, multiple optimized shocks of greater than 50 μC, for example, are delivered to a subject at about 10-30 pulses per second.

Figure 2:
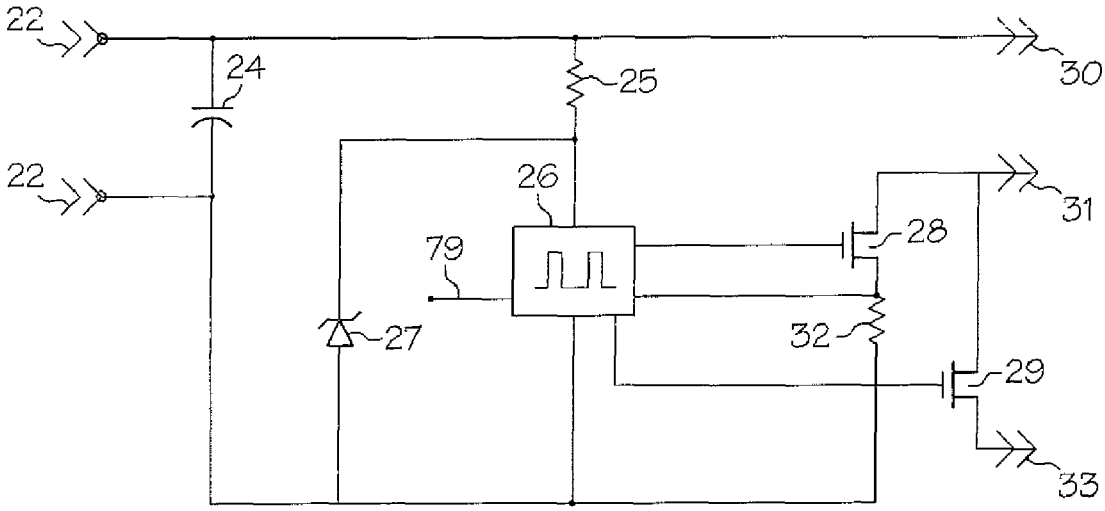
FIG. 2 is a schematic diagram of the basic circuitry of a wireless projectile in accordance with at least one embodiment of the present invention.

Referring now to FIG. 2, an embodiment of the basic circuitry of the capacitor bullet is shown. On the left, the charging electrodes 22 for the capacitor bullet are depicted The charging electrodes are in electrical communication with the capacitor 24 in the bullet The capacitor 24 stores the primary charge for the bullet. It should be noted that capacitor 24 can be several capacitors and need not be a single capacitor. A large series resistor 25 limits the current delivered to an oscillator 26 and the Zener diode 27 limits the voltage. In some embodiments, the resistor/Zener diode circuit can be replaced with other types of step-down circuits, including one using an inductor, as known by a person of ordinary skill in the art. The oscillator 26 develops a repetitive pulse sequence from the capacitor that is used to control switch 28 in delivering pulses through the front barb or electrode 30, or "probe," in the bullet and the rear barb or electrode 31. An optional second front electrode 33 will be discussed later.

In at least one embodiment, the oscillator 26 is combined with a microcontroller. The oscillator, and if present, microcontroller can be powered using a variety of different methods, including using a step-down inverter. In at least one embodiment, the switch 28 is a semiconductor switch, such as a Field Effect Transistor (FET), as shown. One of ordinary skill in the art will understand that it may be desirable for the switch to be a MOSFET, power MOSFET, or any number of other semiconductor switches that need not be specifically enumerated herein. Current sensor resistor 32 is used by the oscillator 26 to sense when a sufficient total charge has been delivered into the subject through the electrodes 30. As seen in FIG. 2, the wireless projectile does not comprise a battery and does not comprise an inverter to charge the capacitor. As mentioned above, a second front electrode 33 can be included in an alternate embodiment. As with the rear electrode 31, the oscillator 26 develops a repetitive pulse sequence from the capacitor 24 that is used to control switch 29 in delivering pulses to the second front electrode 33

Figure 3:
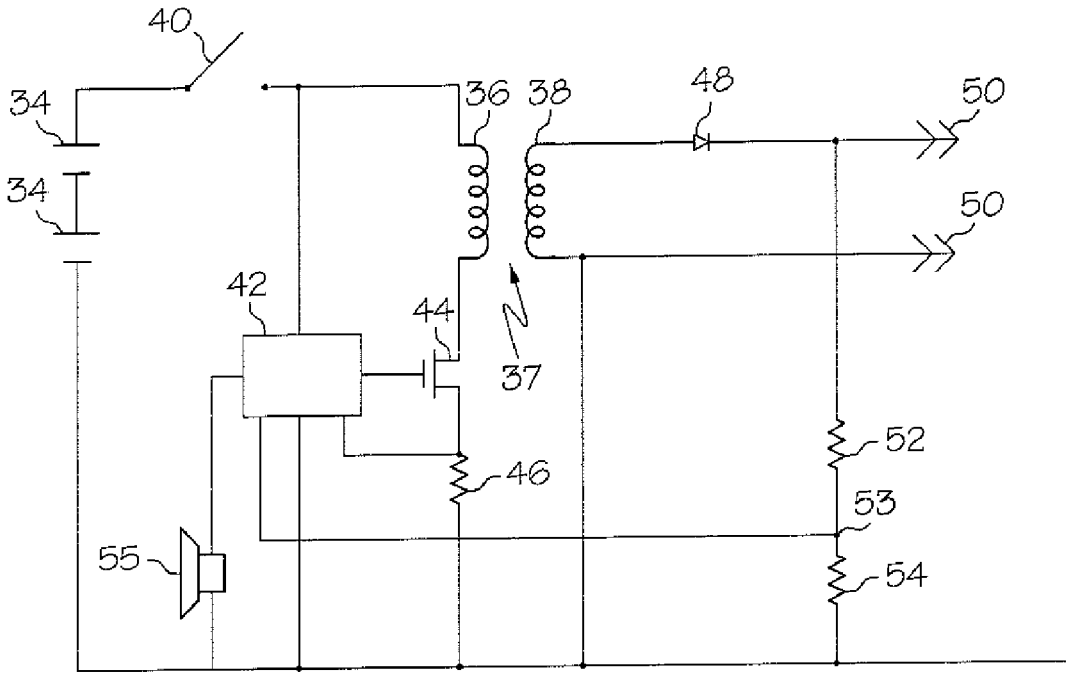
FIG. 3 is a schematic diagram of the basic charging circuitry of a hand-held ECD in accordance with at least one embodiment of the present invention.

FIG. 3 illustrates one embodiment of the charging circuitry in the pistol itself. Two battery cells 34 are used to power the inverter composed of windings 36 and 38. While two cells are illustrated, it may be desirable to include more than two cells, or only a single cell if that cell has sufficient capacity. In some embodiments, the cells are lithium-ion.

FIG. 3 further depicts a safety switch 40. When the safety switch 40 is in a closed position, the cells 34 power the oscillator 42 The oscillator controls the semiconductor switch 44, thereby pulsing power through the primary winding 36 of the transformer 37. Current sensing resistor 46 monitors the current through the primary winding 36; the oscillator 42 will immediately remove the current through the primary when the optimal current is achieved. The optimal current is typically about 80-90% of the core saturation current When this current is turned off, the "flyback" voltage from secondary winding 38 is passed through the diode 48 into the charging electrode 50 (which contacts charging electrode 22 shown in FIG. 2) An output voltage between about 300-600 volts is measured through a voltage dividing resistor network 52, 54 and fed back to the oscillator 42. Typical examples for the resistors 52 and 54 would be respectively 200 kΩ and 1 kΩ.

Some embodiments of the present invention include an alarm mechanism for alerting the user by producing an alarm signal if no connection exists between the trigger and a projectile. Referring again to FIG. 3, the connection is determined by measuring whether a 2-volt voltage pulse exists on the node 53 between resistors 52 and 54 at the start of charging. This voltage suggests that there is no capacitor in the circuit at node 50, meaning that the round is defective, not properly seated, or not present. In some embodiments, the alarm signal is an audible alarm, as shown at 55. However, the alarm could be tactile as well.

Figure 4:
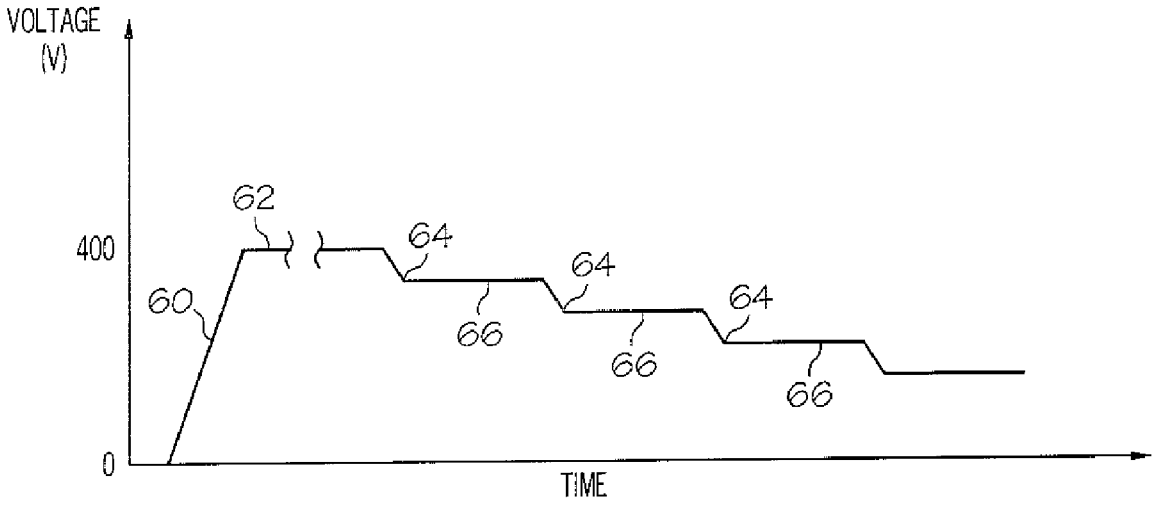
FIG. 4 is a diagram depicting the capacitor voltage during discharge of a wireless projectile in accordance with at least one embodiment of the present invention.
Figure 5:
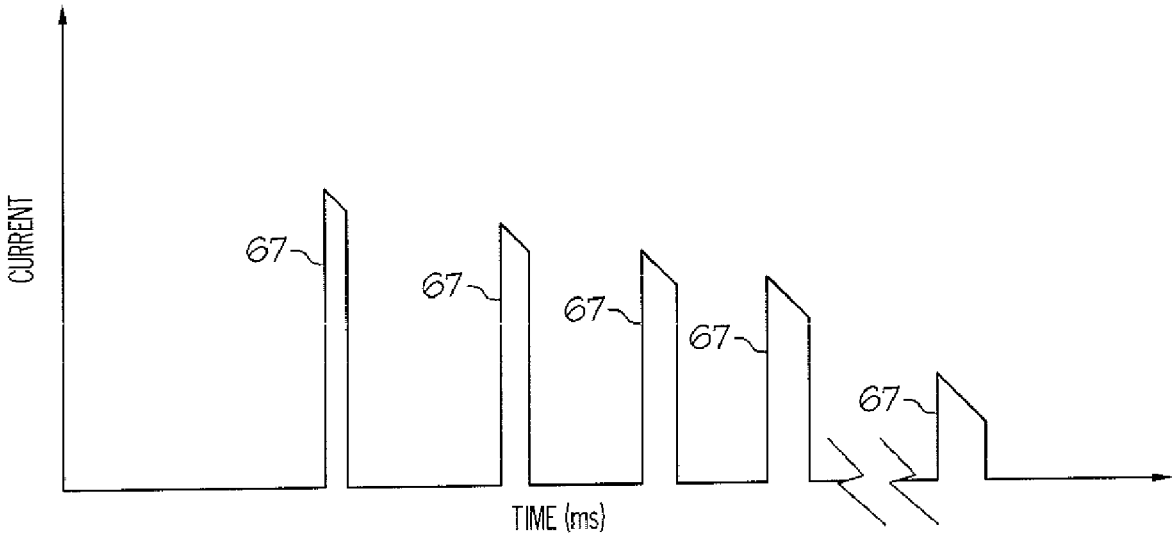
FIG. 5 is a diagram depicting the current delivered from a wireless projectile to a subject in accordance with at least one embodiment of the present invention.

FIG. 4 graphically depicts the charge on the capacitor in the capacitor bullet as it is charged and then discharged. The capacitor is first charged during the time period 60 to a typical peak voltage of about 400 volts. The capacitor maintains a charge of about 400 volts for a time period 62 during which the bullet is launched towards the subject. When the first pulse is delivered into the subject over time period 64, the voltage will be decreased as charge is delivered to the subject. Subsequently, there is a time period 66 of approximately 50 milliseconds between pulses in which no charge is delivered to the subject. This sequence of a pulse delivered over a time period 64 and no-pulse over a time period 66 continues until the capacitor is approximately half discharged FIG. 5 graphically illustrates the current delivered to the subject from an embodiment of a capacitor bullet. The current delivered is depicted as pulses 67 lasting approximately 50-200 microseconds. Each successive current pulse is smaller in peak current magnitude and longer in duration than the previous current pulse. There is a space between the pulses of approximately 50 milliseconds As seen in FIG. 4, the peak voltage continues to decrease as the capacitor is gradually discharged during the delivery of the shock. Referring again to FIG. 5, it should be noted that the pulse durations increase to correct for the reduction in the capacitor voltage. This increase in duration ensures a constant charge per pulse, which is what determines muscle capture The average current (=charge*pulse rate) is thus constant This method of operation is significantly different from the device described in U.S. Pat. No. 6,862,994 The device described in U.S. Pat. No. 6,862,994 simply delivers all of the energy of the capacitor into a subject in a single, large bolus, rather than in a series of pulses The energy storage capability calculations of a 0.45 caliber round are depicted immediately below:

- Assume a 45 caliber round has an inner diameter=1 cm
- The volume of a 3 cm long cylindrical capacitor with an inner diameter of 1 cm=$(\pi d^2)/4$*length≈2.25 cc.
- The energy density of a typical capacitor in a camera flash≈3 joules/cc
- Thus, the total energy stored in the cylindrical capacitor above=3 joules/cc*2.25 cc=6.75 joules.

The capacitor in a camera flash is used as an example in order to show that it is practical for a capacitor to have an energy density of about 3 joules/cc, as is common in a typical camera flash Thus, in some embodiments of the capacitor bullet, the capacitor can store a total energy of about 6.75 joules (J)

The charge budget for the capacitor bullet is calculated immediately below:

- Energy stored in a capacitor=$\frac{1}{2}CV^2$. From above, Energy=6.75 joules. V=400 volts Thus, C=84 μF.
- Stored charge=CV=400 V*84 μF=33.75 mC.
- Assuming no pulse is delivered that is less than 200 V, delivered charge=CV=(400 V−200 V)*84 μF=168 mC.
- Using 100 μC pulses: 16.8 mC/100 μC=168 pulses can be delivered.
- If 19 pulses per second are delivered, pulses can delivered for about 9 seconds.

As described above, the energy stored in the capacitor bullet is equal to about 6.75 J Because the voltage is approximately 400 V, the capacitance equals about 84 microfarads. The total charge stored by the capacitor is given by 400 V×84 microfarads, or about 33.75 mC. To be conservative, it is assumed that no pulses have less than a 200 V potential. As such, the delivered charge is equal to (400 V−200 V)×84 μF=168 mC. Using 100 μC pulses, the capacitor bullet can deliver 168 pulses. At a rate of 19 pulses per second (pps), the capacitor bullet can deliver pulses for about 9 seconds, sufficient to control a subject.

Figure 6:
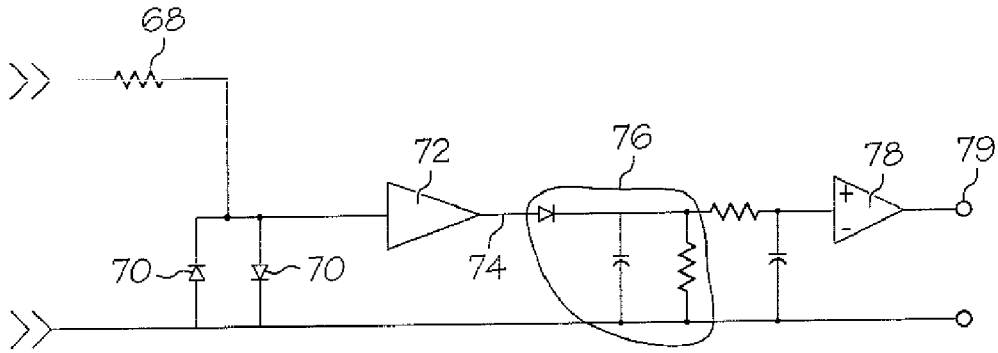
FIG. 6 is a diagram depicting a sensing circuit used by a wireless projectile to detect other wireless projectiles in accordance with at least one embodiment of the present invention.

It may be important for bullets to sense the activity of other bullets that may have lodged in the same subject at the same time in the same area FIG. 6 is an embodiment of a circuit used to sense the activity of other bullets in a subject. The input resistor 68 limits the current and the anti-parallel diodes 70 limit the voltage going into an amplifier 72. The input of FIG. 6 is the current induced as a result of the pulsating electric field from the other bullet. The amplifier output 74 is then peak captured with a peak detector 76 with conventional capacitor, diode, and resistor circuitry and amplified by amplifier 78 for the output. The output 79 of amplifier 78 is fed into the microcontroller which controls the oscillator.

It should be noted that although polarized capacitors are depicted in FIGS. 2 and 6, the present invention is not restricted to using only polarized capacitors. In some embodiments the capacitors are not polarized.

Figure 7:
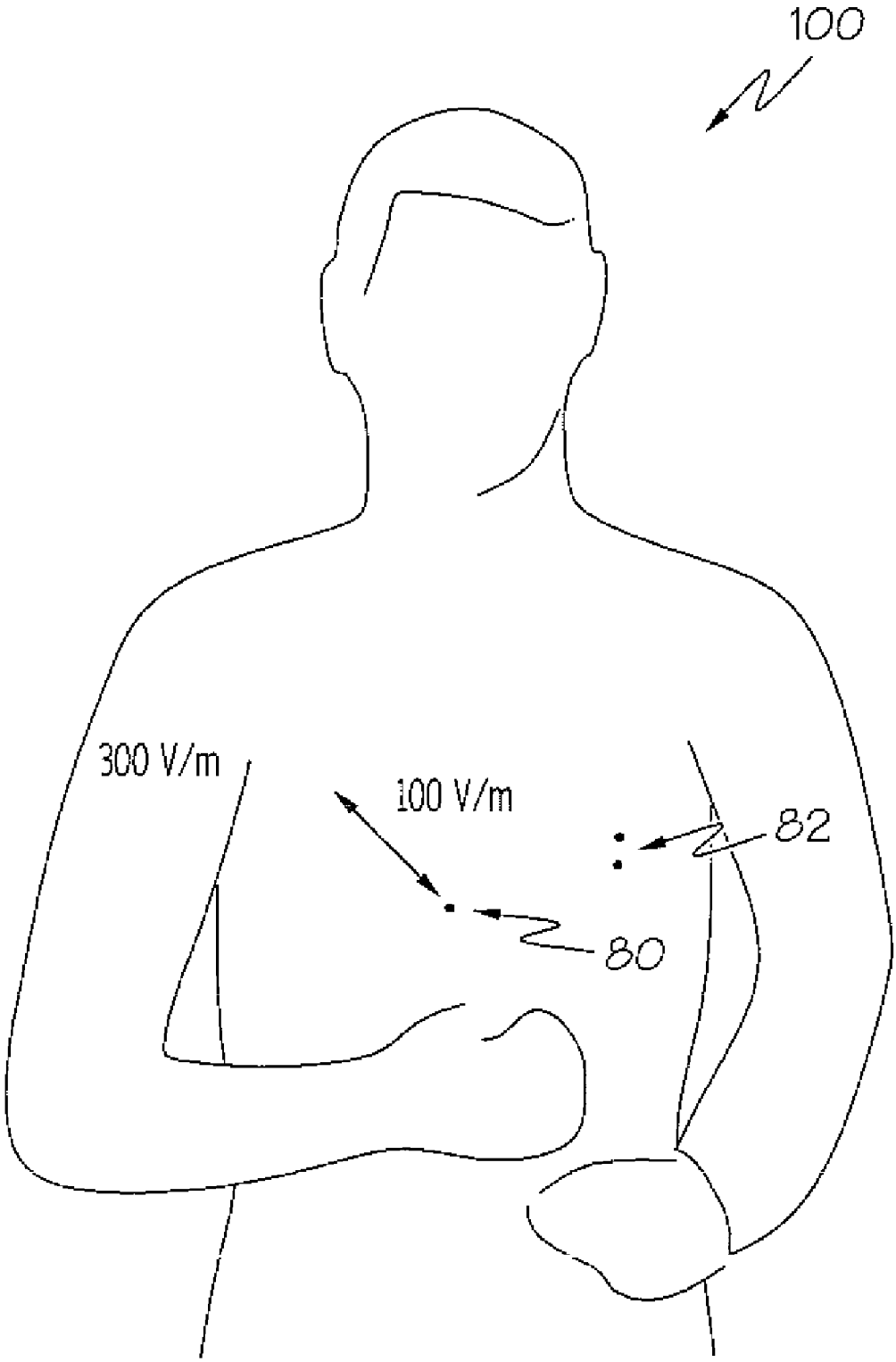
FIG. 7 illustrates the typical impact of multiple wireless projectiles on a subject and the associated field strength in accordance with at least one embodiment of the present invention.

Referring now to FIG. 7, the typical impact of multiple bullets 80, 82 on the subject 100 is illustrated When the first bullet 80 lands in the middle of the subject's chest, the subject 100 reacts naturally by reaching with an arm to grab it. It should be noted that because only a single probe is used in the first bullet 80, no electric shock is delivered to the subject upon impact. At least a portion of the housing of the capacitor bullet is conductive and is in electrical communication with a first plate of the capacitor via front electrode 30, while the probe is in electrical communication with the second plate of the capacitor is the rear electrode 31. As such, a circuit is completed only when the subject grabs the bullet embedded in the subject's chest as a natural reaction to the impact. The current delivered to the subject is sufficient to prevent the subject from letting go of the bullet because the current exceeds the "let-go" stimulation level. There is no problem with additional capacitor bullets landing as no current path exists until the subject grabs the second or later bullet The ability to launch multiple rounds is critical as the majority of trigger pulls in stressful situations lead to misses in police encounters.

In an alternative embodiment, the bullet will have a second front electrode 33. This second front electrode can be either a smaller probe or a conductive "collar" or "ring" at the front of the housing The electric field in the subject's arm is about 300 volts/meter (V/m) from a first bullet landing and being grabbed. The electric field in the subject's chest, however, is significantly less—about 100 V/m—due to the decreased resistance in the chest muscles A second bullet 82 landing with its two front prongs (with a spacing between prongs of about 1 cm) would thus sense a field from the first bullet of about 100 V/m×1 cm spacing, resulting in a maximum signal of about 1.0 V. If a ring electrode is used, a smaller field exists.

Figure 8:
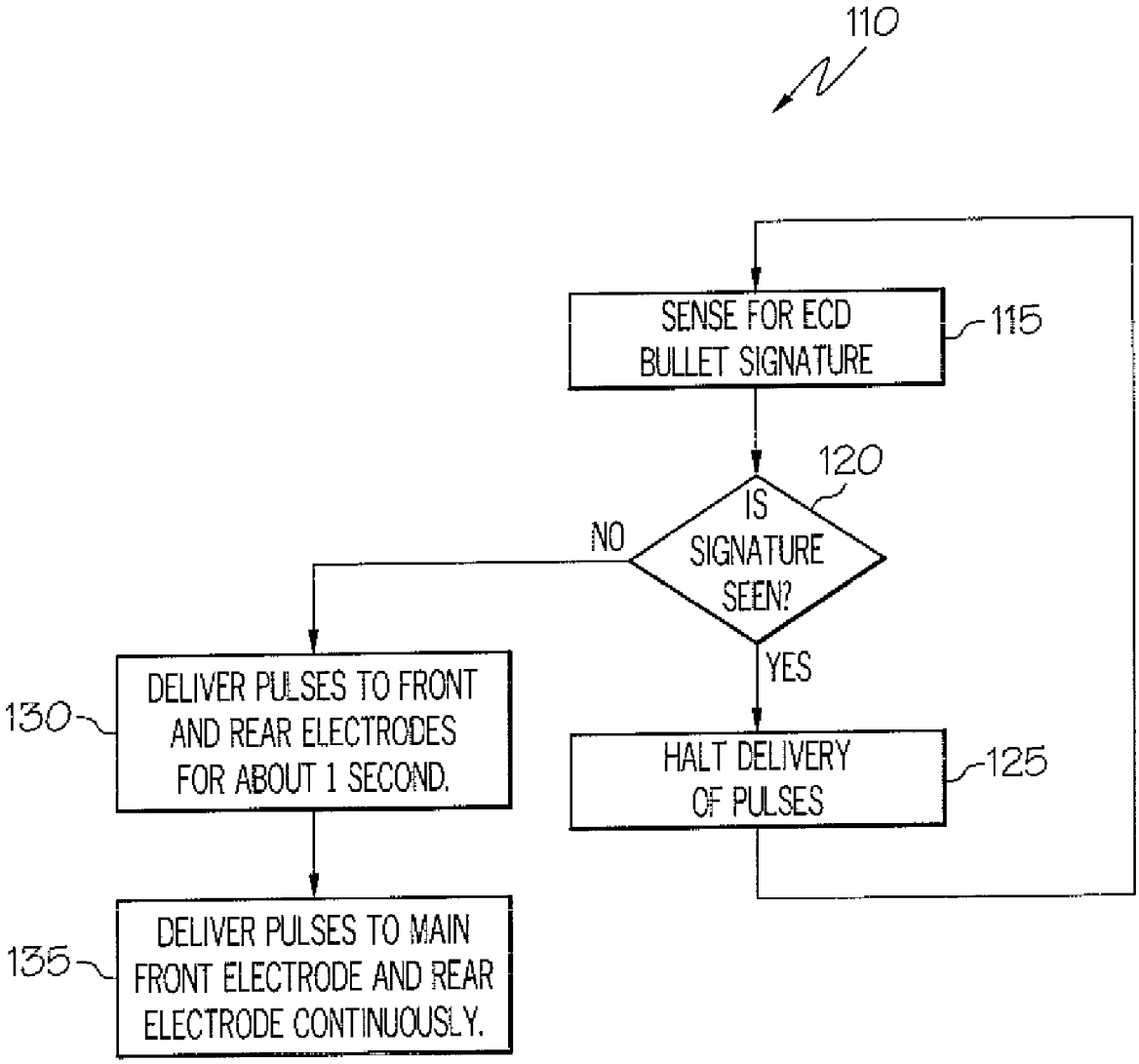
FIG. 8 depicts a method of multiple wireless projectile operation in accordance with at least one embodiment of the present invention.

FIG. 8 depicts a method 110 for detecting the presence of another capacitor bullet in a target, such as in the embodiment depicted in FIG. 7 In the embodiment shown in FIG. 8, a second wireless projectile is fired at the target. In the first step 115, the method senses for the signature of the first capacitor bullet. If a signature is detected at 120, it will halt the delivery of pulses at 125 in order to conserve its energy, allowing pulses to be delivered subsequently, if necessary. The signature is a pulse rate of about 20 pulses per second, each pulse having a width of about 100 μs. However, if a signature is not detected at 120, "tickle" pulses are delivered to the main front electrode for about 1 second while pulses are also delivered to the rear electrode, as shown at 130. The subject will then proceed to grab or slap at the bullet, thereby imbedding the rear probe into the subject's hand. After about 1 second, the tickle pulse in the front electrode is replaced by a continuous pulse between the main front electrode and the rear electrode, as shown at 135, creating an electric field capable of muscle capture.

Figure 9:
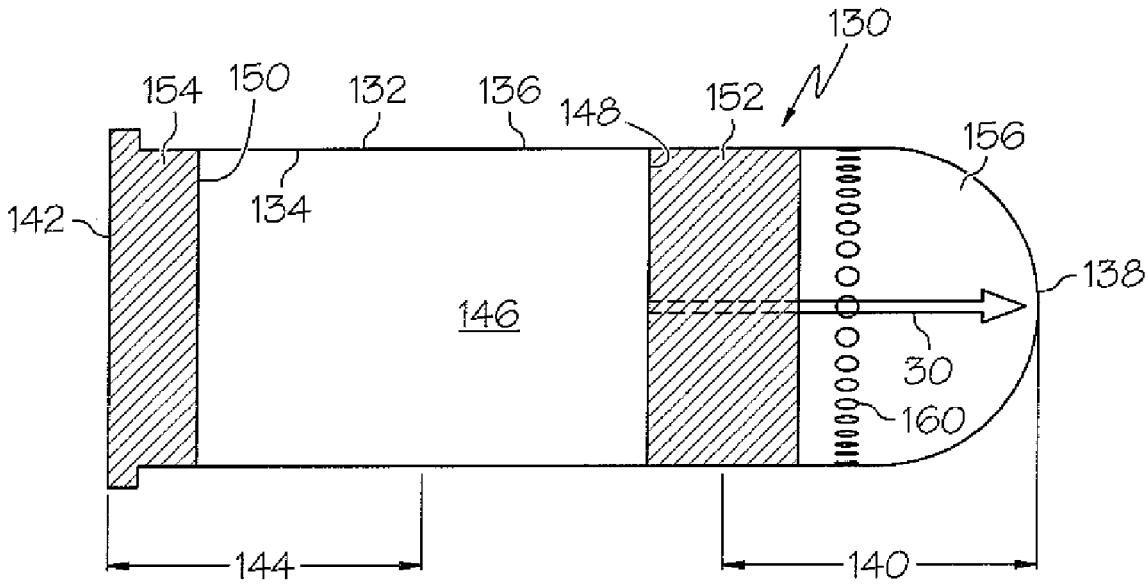
FIG. 9 depicts a wireless projectile in an undeployed, first state, in accordance with at least one embodiment of the present invention.

FIG. 9 shows a drawing of a wireless projectile, or capacitor bullet, 130, in an intact, pre-impact, or first, state. The projectile has a housing 132 with an interior 134 and exterior 136. The housing further includes a front end 138, a front end region 140, a back end 142, and a back end region 144. A capacitor 146 is disposed within the interior of the housing 132 between the front and back ends In some embodiments, the capacitor is situated largely in the back two-thirds of the bullet. The first conductive electrode 148, or plate, of the capacitor is in electric communication via a first lead (not shown) with a first charging member 152 located toward the front end. The second conductive electrode 150, of the capacitor is in electric communication via a second lead (not shown) with a second charging member 154 located in the back end region. It should be noted that in at least one embodiment, the first and second leads may exit the capacitor from the same end. In some embodiments, the first and second charging members are positioned within the interior of the housing. In at least one embodiment, the charging members are positioned on the exterior of the housing. In some embodiments, as in FIG. 9, the charging members are rings. Although rings are described, the charging members could also be antipodal plates that cover a sufficient angle to make contact regardless of the orientation.

Still referring to FIG. 9 the capacitor bullet also includes an embodiment of a kinetic energy absorption material. The front end region 140 of the bullet includes a nose cone 156 comprised of a water-based polymer for absorbing energy.

The front end region 140 of the bullet further includes one or more sharp probes 30 embedded inside the nose cone. The probe(s) and at least a portion of the housing 132 are in electrical communication with the capacitor 162. For example, the probe is in electric communication with the capacitor's first conductive electrode and a portion of the housing is in electrical communication with the capacitor's second conductive electrode. In such a manner, a circuit is created when a probe is in contact with a subject and when the subject has grabbed the housing of the projectile.

The nose cone 156 includes one or more over-pressure release pores 160 The term pore as used herein is defined as a small opening serving as an outlet. Upon impact, to absorb energy, the water-based polymer in the nose cone will blow out through the over-pressure release pores, ensuring that there is only enough energy for the probe to penetrate into the skin, without doing more damage. The goal is to do no ballistic damage to the subject, regardless of the range of the launch. While pores may be used, alternative embodiments may use a nose cone that is designed with material that is thinner in some spots such that those spots are designed to rupture upon impact. In another embodiment, one-way valves may be used.

Figure 10:
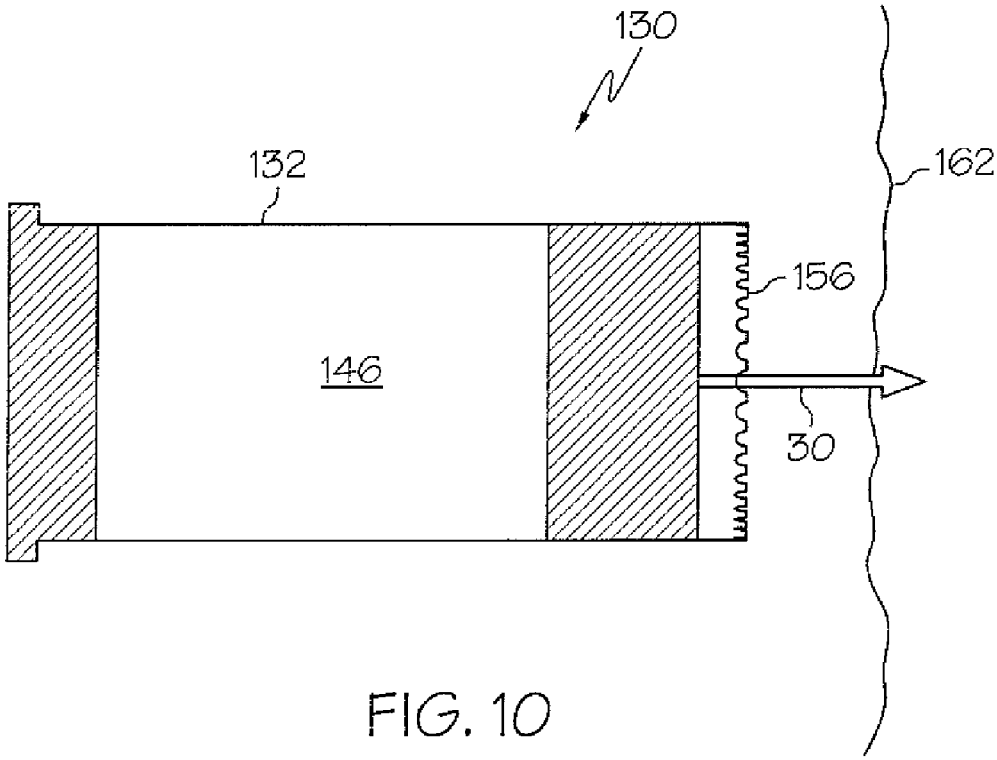
FIG. 10 depicts the wireless projectile of FIG. 9 in a deployed, second state, in accordance with at least one embodiment of the present invention.

FIG. 10 depicts the projectile 130 of FIG. 9 in a deployed, impacted, or second, state. In the second state, the nose cone 156 of FIG. 9 has expelled its kinetic energy absorption material and collapsed The probe 30 has pierced through the nose cone and the front end of the housing and embedded itself into the skin 162 of a subject.

Figure 11:
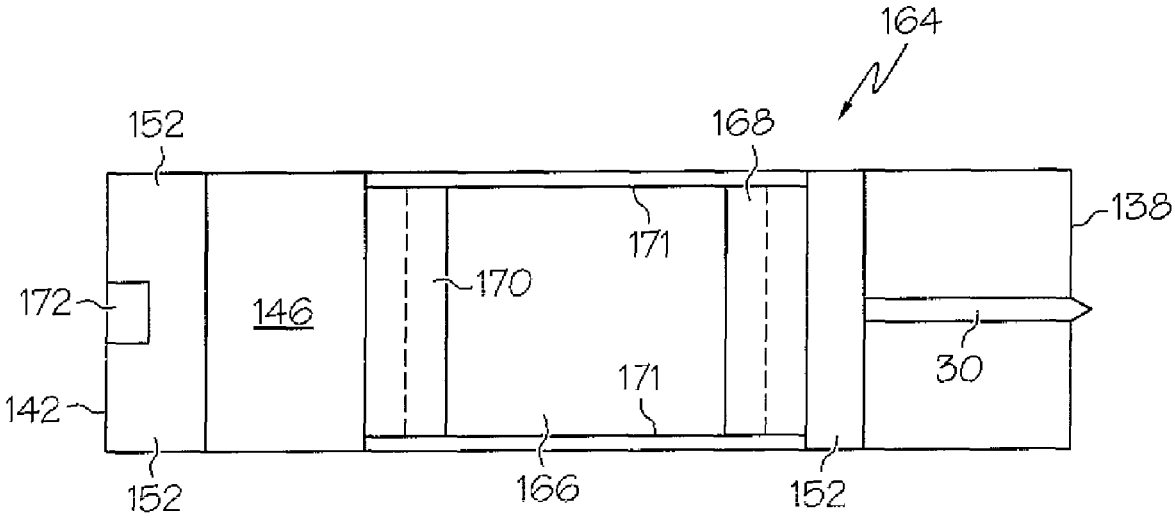
FIG. 11 depicts a wireless projectile in an undeployed, first state, in accordance with at least one embodiment of the present invention.

FIG. 11 depicts another embodiment of a capacitor projectile with kinetic energy absorption capability. This embodiment shows a shotgun round 164. The energy absorption is accomplished by an air gap 166 and telescoping shear rings 168, 170. Upon impact, the telescoping shear rings 168, 170 fail, as designed. Ring 168 telescopes into ring 170. As such, the shotgun round 164 compresses into the air gap, thereby absorbing a portion of the impact energy. Charging rings 152 are shown, along with the probe 158. It should be noted that the charging ring closest to the front end 138, which is separated from the capacitor by the air gap prior to impact, maintains electrical communication with the capacitor prior to and after delivery through conductors 171 thereby ensuring that a shock is delivered to the individual. It should also be noted that the air gap energy absorption design is not limited to shotgun rounds, nor is the water polymer energy absorption design limited to bullets. Rather, in some embodiments, a water polymer energy absorption design can be used in shotgun rounds and an air gap energy absorption design can be used in bullets. The shotgun shell can also include a primer 172 for expelling the round from the gun It should be noted that in some embodiments the wireless projectile depicted in FIGS. 9 and 10 can also include a propellant such as a primer. It should be further noted that in at least one embodiment, the propellant can be a primer used in conjunction with gunpowder.

Figure 12:
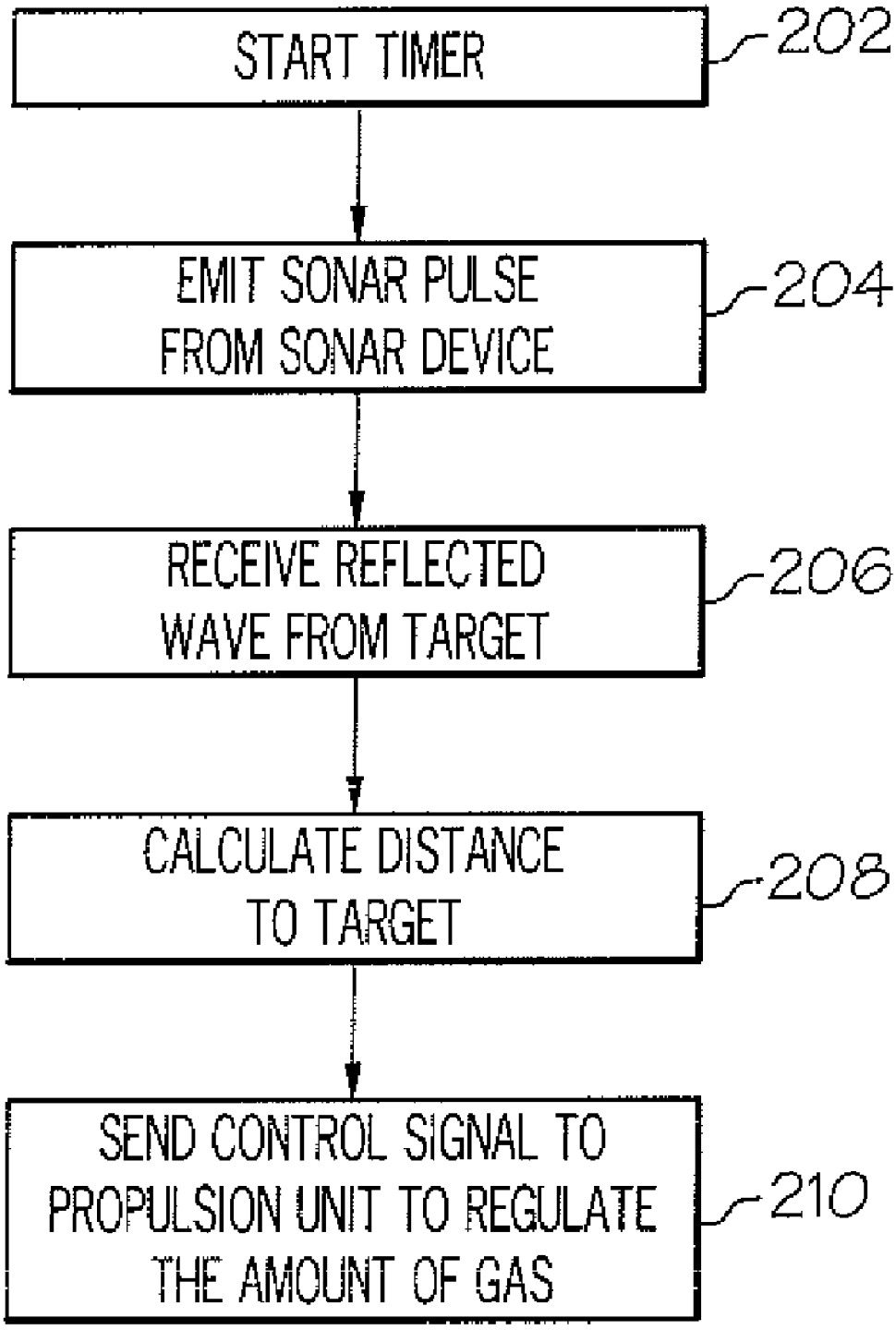
FIG. 12 depicts a block diagram illustrating the use of a sonar device with an ECD, in accordance with at least one embodiment of the present invention

Some embodiments of the electronic control device include a sonar range finder, such as shown at 200 in FIG. 1. The sonar range finder is designed to determine the distance from the ECD to a target, and based on that distance, control the amount of gas used to expel the projectile from the ECD. The process is illustrated in FIG. 12. A timer is started (202) at the same time that a sonar pulse is emitted from the sonar device (204). The wave reflected from the target is received by the sonar device (206) The timer is stopped and a microprocessor, microcontroller, or other device capable of performing arithmetic functions calculates the distance to the target (208). Specifically, the timing of the return is divided by about 330 meters per second to derive the round trip distance, which is then divided by 2 to find the distance to target. A controller signal is then sent from the microprocessor to the propulsion unit to regulate the amount of gas to be used to expel the projectiles (210). A person of ordinary skill will recognize that there are numerous ways to achieve such a design. For example, the propulsion unit may be engaged to an electronically controllable valve that will open in response to a first signal sent from the microprocessor and close in response to a second signal. In such a manner, the amount of gas can be closely regulated.

Figure 13:
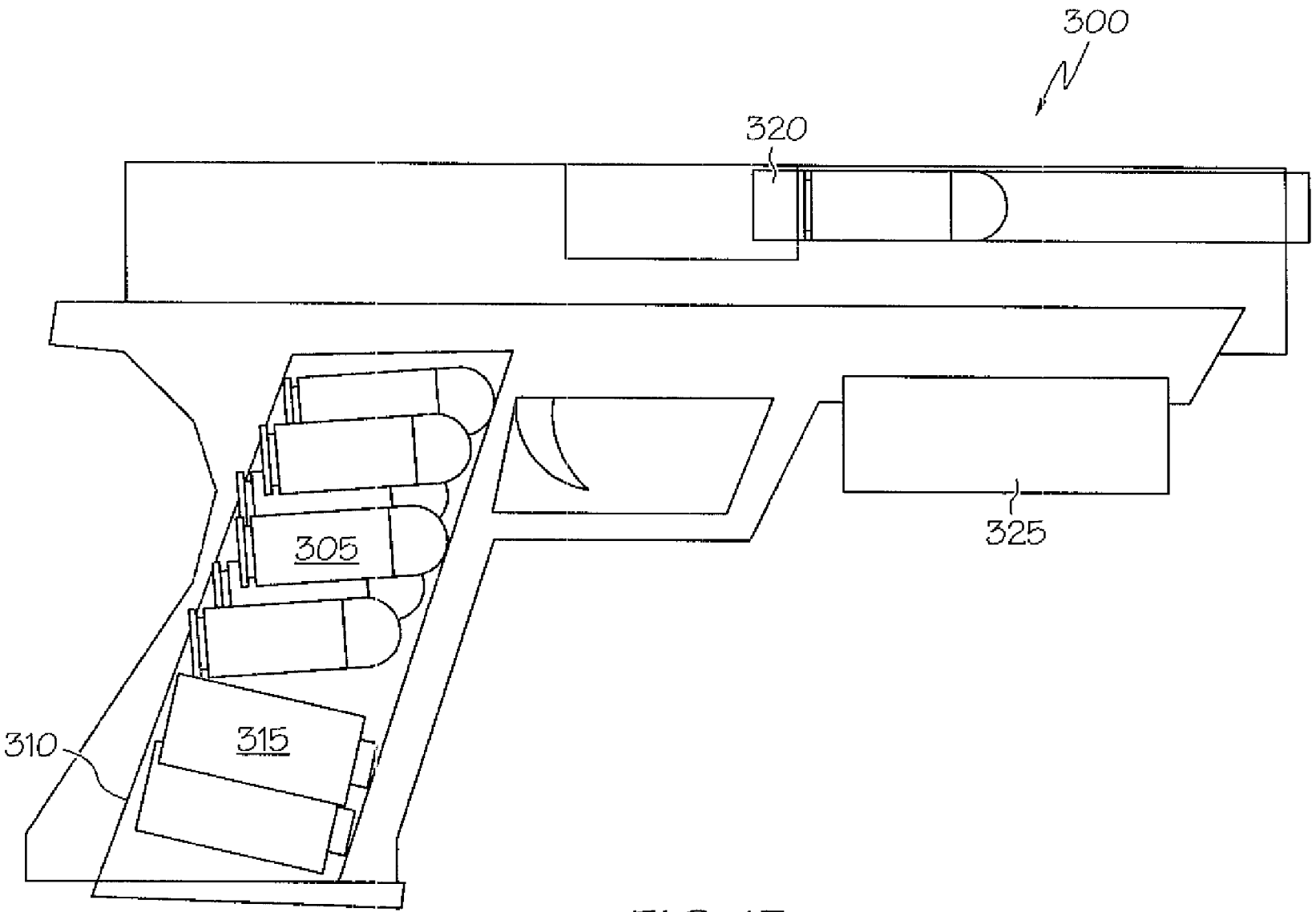
FIG. 13 is a side cutaway view of a hand-held ECD in accordance with at least one embodiment of the present invention.

FIG. 13 depicts an embodiment for a primer or primer and gun powder propellant method for discharging an ECD wireless projectile. The hand-held weapon 300 functions in the same manner as any modern semi-automatic handgun. The projectiles 305 are loaded into the magazine 310 along with the batteries 315 The projectiles are charged as they are loaded into the chamber and make contact with the electrodes on the bolt 320. A laser sighting system 325 can be attached to assist in aiming.

Figure 14A:
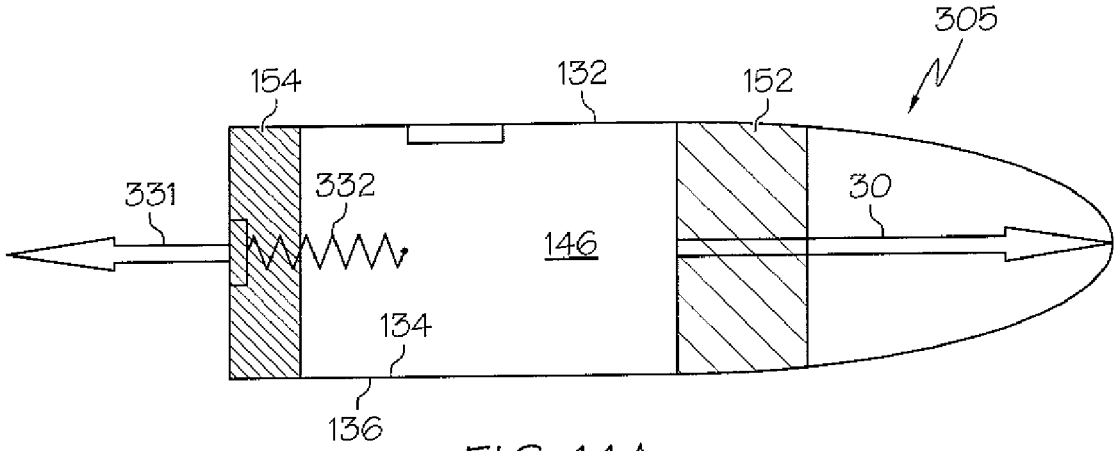
FIGS. 14A-14C depict a wireless projectile in accordance with at least one embodiment of the present invention.
Figure 14B:
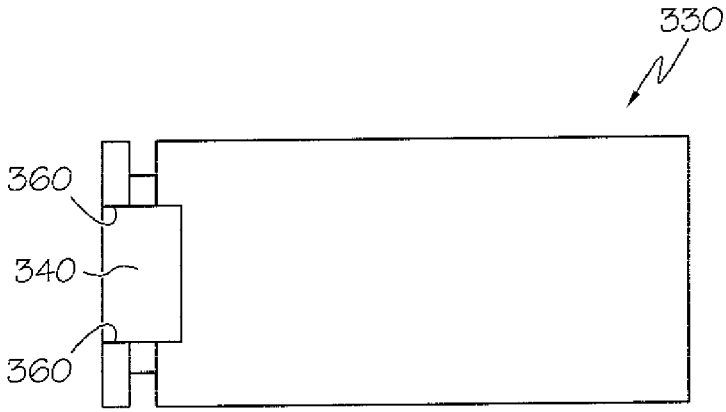
Figure 14C:
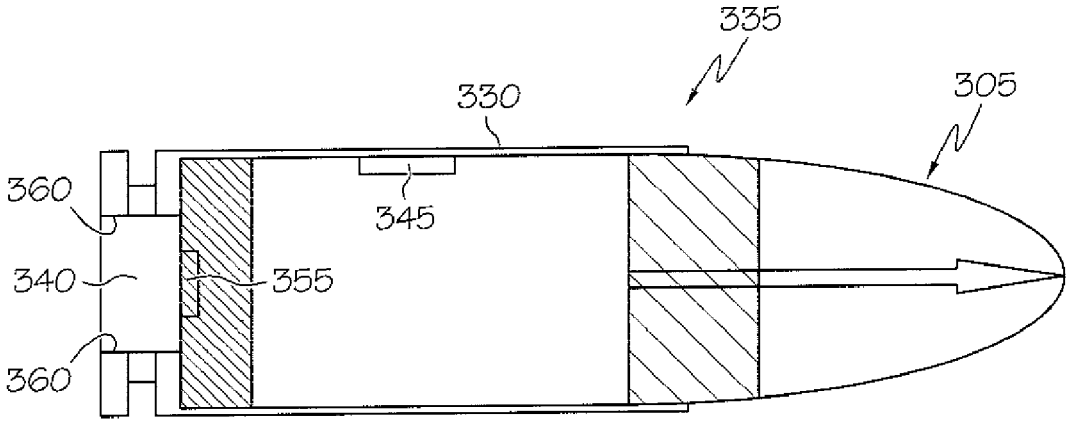

FIGS. 14A-14C depict an embodiment for a powder propelled wireless projectile 305 FIG. 14A depicts the projectile 305 which has an optional barb 331 for the rear electrode The barb is designed so as to fit within the casing 330 (described below and shown in FIG. 14B). The barb 331 is in electrical communication with the capacitor. In some embodiments, the barb 331 may be connected through a thin wire or conductor 332 to allow the subject to pull his arm back while still maintaining an electrical connection between the barb and the capacitor. In some embodiments, the wire 332 may be folded and about 2 meters long.

FIG. 14B depicts the conductive casing or "shell" 330. FIG. 14C shows the projectile combined with the casing at 335 The projectile is discharged from the hand-held ECD device when a firing pin (not shown) strikes the primer 340, which then ignites the gun powder, thereby propelling the projectile. For low velocity, close-range applications, the force of the primer 340 alone may be sufficient to propel the projectile The projectile's capacitor(s) are charged through electrode 345, which makes contact with the conductive casing 330 of the cartridge, and by electrode 355, which makes contact with the conductive primer 340. The conductive primer 340 is insulated from the cartridge casing 330 by an insulating material 360 such as parylene.

FIG. 14C depicts the projectile 305 shown in FIG. 14A in combination with the casing 330 shown in FIG. 14B The combination of FIG. 14C shows the projectile and casing in a first state, wherein the casing 330 is disposed at least partially about the housing 132 of the projectile 305. After the projectile has been fired, the casing and housing separate, leaving the projectile 305 of FIG. 14A to impact the target.

Figure 14D:
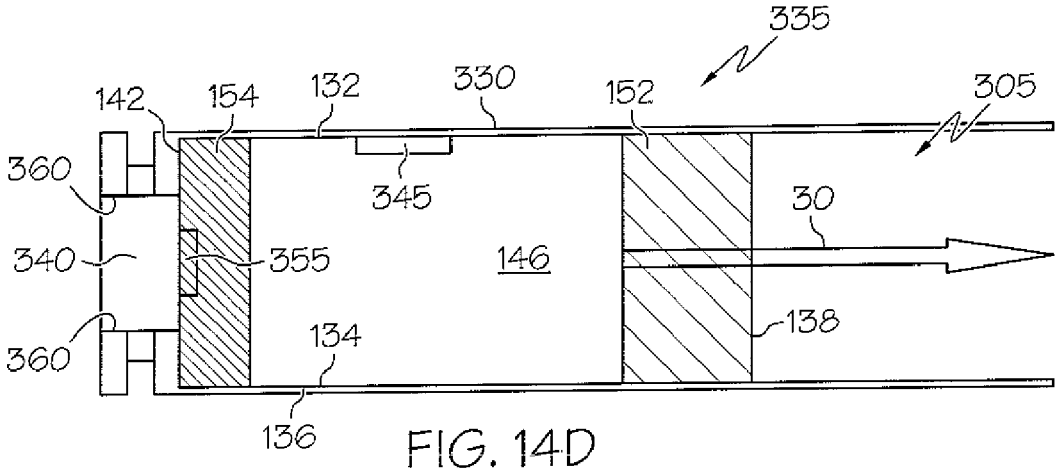
FIG. 14D depicts the wireless projectile shown in FIG. 14C but with the casing extending beyond the front probe in accordance with at least one embodiment of the present invention.
Figure 15A:
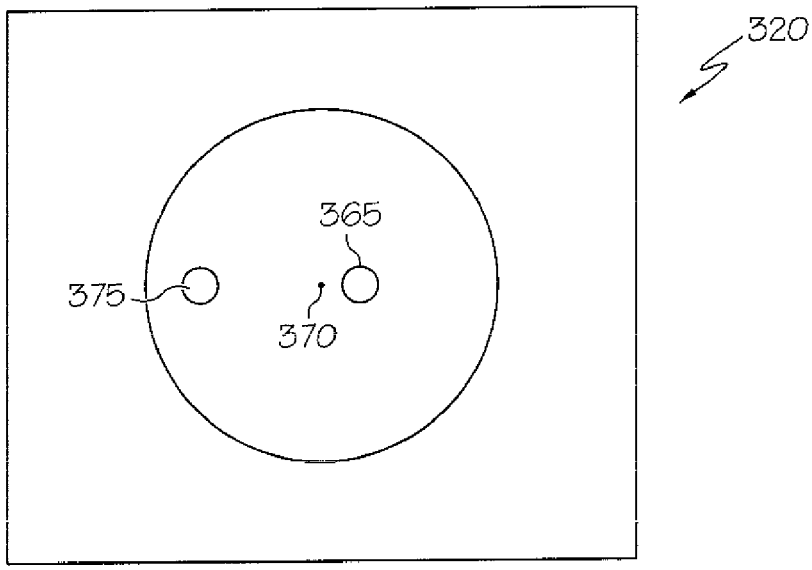
FIGS. 15A-15B depict a bolt assembly of a hand-held ECD in accordance with at least one embodiment of the present invention.
Figure 15B:
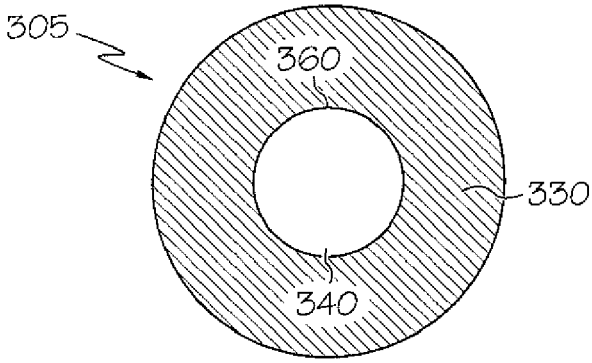

FIG. 14D depicts an alternative embodiment in which the projectile 305 does not have a nose cone. Rather, the casing 330 extends longitudinally beyond the tip of the front probe 30 in order to protect the probe during feeding from the magazine FIG. 15A depicts the bolt assembly 320 of a hand-held ECD device and FIG. 15B shows the rear portion of a powder propelled wireless projectile 305. The charging electrode 365 near the firing pin 370 in FIG. 15A makes electrical contact with the primer 340 in FIG. 15B. The charging electrode 375 in FIG. 15A makes electrical contact with the rear portion of the cartridge casing 330 in FIG. 15B. The conductive primer 340 is electrically insulated by insulating material 360 from the conductive casing 330. Parylene may be used as the insulating material 360.

Some embodiments of the present invention can be described by the following number paragraphs:

20. A hand-held electronic control device, the electronic control device comprising:

a barrel;

a magazine, the magazine engaged to the barrel, the magazine constructed and arranged to house the wireless projectile of claim 1;

at least one battery, the at least one battery in electrical communication with an inverter, the inverter in electrical communication with at least one projectile, wherein the inverter charges the at least one projectile; and at least one propulsion unit, the at least one propulsion unit constructed and arranged to expel the projectile from the electronic control device.

21. The electronic control device of claim 20, wherein the propulsion unit is filled with a gas, the electronic control device further comprising a sonar range finder, the sonar range finder constructed and arranged to control the amount of gas used to expel the projectile from the electronic control device.

22 The electronic control device of claim 20, wherein the wireless projectiles are individually propelled by a propellant, the propellant being selected from the group consisting of a primer and a primer and gunpowder.

23. The electronic control device of claim 21, further comprising an alarm mechanism, the alarm mechanism constructed and arranged to produce an alarm signal if no connection exists between a trigger and a projectile.

24. The electronic control device of claim 23, wherein the alarm signal is an audible alarm.

25. The electronic control device of claim 20, further comprising a video camera 26. A method of detecting the presence of a first wireless projectile in a target, the method comprising:

firing a second wireless projectile as in claim 14 at the target;

sensing for a signature of the first wireless projectile;

delivering first current pulses to a front electrode and a rear electrode for about 1 second if no signature is sensed;

delivering second current pulses to the front electrode and the rear electrode after about 1 second, the second current pulses being larger in peak current magnitude than the first current pulses; and halting delivery of pulses if a signature is sensed.

27. A method of disabling a subject, comprising:

providing a handheld device with a battery positioned within the handheld device and not positioned within a projectile;

generating a voltage greater than 100 V from the battery;

charging a capacitor in the projectile from the voltage, the projectile being temporarily contained within the handheld device;

propelling the projectile toward the subject; and delivering multiple current pulses from the projectile into the subject The above disclosure is intended to be illustrative and not exhaustive. This description will suggest many variations and alternatives to one of ordinary skill in this art. The various elements shown in the individual figures and described above may be combined or modified for combination as desired. All these alternatives and variations are intended to be included within the scope of the claims where the term "comprising" means "including, but not limited to".

Further, the particular features presented in the dependent claims can be combined with each other in other manners within the scope of the invention such that the invention should be recognized as also specifically directed to other embodiments having any other possible combination of the features of the dependent claims.

This completes the description of the preferred and alternate embodiments of the invention. Those skilled in the art may recognize other equivalents to the specific embodiment described herein which equivalents are intended to be encompassed by the claims attached hereto.

What is claimed is:

1. A wireless projectile for use with a hand-held electronic control device, the projectile having a first state and a second state, the projectile comprising:

a housing, the housing having a first end, a second end, a first end region, and a second end region, the housing further having an interior and an exterior;

at least one capacitor disposed within the interior of the housing between the first end and the second end, the capacitor being in electrical communication with a first charging member and a second charging member;

at least one probe, the at least one probe in electrical communication with the capacitor, wherein the at least one probe is disposed within the housing in the first end region in the first state, and wherein the at least one probe extends through the first end of the housing in the second state, and wherein the at least one probe delivers a plurality of current pulses to a subject; and wherein the projectile does not comprise a battery, and wherein the projectile does not comprise an inverter to charge the at least one capacitor.

2. The projectile of claim 1, wherein each successive current pulse is smaller in peak current magnitude and longer in duration than the previous current pulse, and wherein each pulse delivers a charge, the amount of charge being delivered by each pulse being substantially constant.

3. The projectile of claim 1, wherein in the first state, the projectile further comprises kinetic energy absorption material, the kinetic energy absorption material being located substantially within the first end region.

4. The projectile of claim 3, wherein in the first state, the projectile further comprises at least one over-pressure release pore, the projectile constructed and arranged to expel at least some of the kinetic energy absorption material through the at least one pore upon transitioning from the first state to the second state.

5. The projectile of claim 4, wherein the kinetic energy absorption material is a water-based polymer.

6. The projectile of claim 4, wherein the kinetic energy absorption material is an air gap.

7. The projectile of claim 6, further comprising at least one shearing member.

8. The projectile of claim 7, wherein the at least one shearing member is a telescoping ring.

9. The projectile of claim 1, wherein the second charging member is in electrical communication with the exterior of the housing, and wherein the exterior of the housing is conductive.

10. The projectile of claim 9, further comprising a rear probe, the rear probe extending from the second end of the housing and being in electrical communication with the second charging member.

11. The projectile of claim 10, further comprising a folded conductor, the conductor engaged between the rear probe and the second charging member.

12. The projectile of claim 1, wherein the first charging member is a first ring, and the second charging member is a second ring.

13. The projectile of claim 1, wherein the capacitor is in electrical communication with an oscillator, and wherein the at least one probe is in electrical communication with a switch, and wherein the switch is in electrical communication with the oscillator.

14. The projectile of claim 13, further comprising a current sensing element, the current sensing element in electrical communication with the oscillator.

15. The projectile of claim 14, wherein the current sensing element is a resistor.

16. The projectile of claim 13, further comprising sensing circuitry, the sensing circuitry constructed and arranged to detect other projectiles.

17. The projectile of claim 16, wherein the sensing circuitry comprises a current limiting element, a voltage limiting element, and a first amplifier, wherein the current limiting element and the voltage limiting element are engaged to an input of the amplifier, the amplifier having an output, the output being in electrical communication with a peak detector, the peak detector being in electrical communication with the input of a second amplifier.

* * * * *

UNITED STATES PATENT AND TRADEMARK OFFICE

CERTIFICATE OF CORRECTION

PATENT NO. : 7,859,818 B2
APPLICATION NO. : 12/250178
DATED : December 28, 2010
INVENTOR(S) : Ryan Kroll et al.

It is certified that error appears in the above-identified patent and that said Letters Patent is hereby corrected as shown below:

On the Title page, in column 2, in field (57), under "ABSTRACT", line 4, after "capacitor(s)", insert -- . --.

In column 1, line 38, after "reference", insert -- . --.

In column 2, line 4, after "below", insert -- . --.

In column 2, line 7, after "1.72", insert -- . --.

In column 2, line 16, after "exterior", insert -- . --.

In column 2, line 44, after "housing", insert -- . --.

In column 2, line 54, after "resistor", insert -- . --.

In column 2, line 57, after "projectiles", insert -- . --.

In column 3, line 4, after "region", insert -- . --.

In column 3, line 11, after "member", insert -- . --.

In column 3, line 13, after "member", insert -- . --.

In column 3, line 27, after "projectile", insert -- . --.

In column 4, line 23, after "invention", insert -- . --.

In column 5, line 9, after "depicted", insert -- . --.

Signed and Sealed this
Fifteenth Day of November, 2011

David J. Kappos

David J. Kappos
*Director of the United States Patent and Trademark Office*

In column 5, line 11, after “bullet”, insert -- . --.

In column 5, line 42, after “electrode 33”, insert -- . --.

In column 5, line 51, after “oscillator 42”, insert -- . --.

In column 5, line 57, after “current”, insert -- . --.

In column 5, line 61, after “FIG. 2)”, insert -- . --.

In column 6, line 21, after “discharged”, insert -- . --.

In column 6, line 28, after “milliseconds”, insert -- . --.

In column 6, line 34, after “capture”, insert -- . --.

In column 6, line 35, after “constant”, insert -- . --.

In column 6, line 37, after “6,862,994”, insert -- . --.

In column 6, line 40, after “pulses”, insert -- . --.

In column 6, line 43, after “cm”, insert -- . --.

In column 6, line 47, after “cc”, insert -- . --.

In column 6, line 54, after “flash”, insert -- . --.

In column 6, line 55, after “joules (J)”, insert -- . --.

In column 7, line 2, after “6.75J”, insert -- . --.

In column 7, line 45, after “bullet”, insert -- . --.

In column 7, line 52, after “housing”, insert -- . --.

In column 7, line 56, after “muscles”, insert -- . --.

In column 7, line 63, after “FIG. 7”, insert -- . --.

In column 8, line 52, after “160”, insert -- . --.

In column 8, line 67, after “collapsed”, insert -- . --.

In column 9, line 37, after “(206)”, insert -- . --.

In column 9, line 57, after “315”, insert -- . --.

In column 9, line 63, after “electrode”, insert -- . --.

In column 10, line 7, after “335”, insert -- . --.

In column 10, line 12, after “projectile”, insert -- . --.

In column 10, line 19, after “14B”, insert -- . --.

In column 10, line 29, after “magazine”, insert -- . --.

In column 11, line 6, after “camera”, insert -- . --.

In column 11, line 29, after “subject”, insert -- . --.